United States Patent [19]

Goralnik

[11] 4,451,767

[45] May 29, 1984

[54] TEMPERATURE SENSITIVE BALLAST CIRCUIT FOR A FLUORESCENT LAMP

[76] Inventor: Charles D. Goralnik, 200 Brynwyck Pl., St. Louis County, Mo. 63141

[21] Appl. No.: 351,158

[22] Filed: Feb. 22, 1982

[51] Int. Cl.[3] ..... H05B 41/14

[52] U.S. Cl. ..... 315/309; 315/310; 315/106; 315/107

[58] Field of Search ..... 315/309, 310, 311, 47, 315/54, 58, 62, 100, 117, 224, 50, 118, 106, 107

[56] References Cited

U.S. PATENT DOCUMENTS

| | | | |
|---|---|---|---|
| 2,359,545 | 10/1944 | Campbell | 315/309 |
| 3,445,721 | 5/1969 | Waymouth | 315/47 X |
| 3,921,032 | 11/1975 | Hallay | 315/106 |
| 4,009,412 | 2/1977 | Latassa | 315/106 |
| 4,178,535 | 12/1979 | Miller | 315/54 X |
| 4,208,616 | 6/1980 | Moerkens | 315/106 |

*Primary Examiner*—Eugene R. LaRoche
*Assistant Examiner*—Vincent DeLuca
*Attorney, Agent, or Firm*—Senniger, Powers, Leavitt and Roedel

[57] ABSTRACT

A ballast circuit for a fluorescent lamp including a gaseous discharge light bulb which for a given input power produces a decreasing amount of light as the bulb temperature decreases below a designed operating temperature at which the amount of light produced is a maximum, the ballast circuit being adapted to be connected in series with the bulb and having a first impedance at the designed operating temperature. The ballast circuit comprises a ballast constituting a primary impedance for the ballast circuit, a secondary impedance, a bi-metal strip for sensing the ambient temperature in the vicinity of the bulb, and a switch connected to the secondary impedance and actuated by the bi-metal strip, the switch being operable to decrease the impedance of the ballast circuit below its first impedance if the ambient temperature falls below a predetermined temperature less than the designed operating temperature to increase the bulb current and thus the light output of the bulb, whereby the light output of the bulb is increased for ambient temperatures below said predetermined temperature.

13 Claims, 4 Drawing Figures

TEMPERATURE SENSITIVE BALLAST CIRCUIT FOR A FLUORESCENT LAMP

BACKGROUND OF THE INVENTION

This invention relates to fluorescent lamps, and more particularly to a temperature responsive ballast circuit for fluorescent lamps both of the small, portable type and the so-called "light fixture" type which are relatively large and intended to be permanently mounted.

The amount of light produced by a fluorescent light bulb for a given input power is dependent on a number of factors, including the temperature of the bulb-wall, which is dependent, in turn, on the ambient temperature in the vicinity of the bulb. Fluorescent bulbs are designed to produce light at a maximum efficiency when the temperature of the bulb-wall is stabilized at 100° F. This occurs when the bulb is operating in a still air environment wherein the ambient temperature is maintained at approximately 77° F. As the ambient temperature is reduced below 77° F., the temperature of the bulb-wall is decreased, which reduces the pressure of the mercury vapor inside the bulb itself, and thus reduces the level of the light output from the bulb. For example, when the ambient temperature in the vicinity of the bulb is 20° F. below the designed operating temperature (e.g., approximately 57° F.), the amount of light output of the bulb is approximately 5% below its maximum; whereas, when the ambient temperature is 40° F. below the designed operating temperature of the bulb (e.g., approximately 37° F.), the amount of light output of the bulb is approximately 30% below its maximum. Because of this temperature sensitivity, fluorescent lamps have been used most extensively for interior lighting. When used for outside lighting in localities where the ambient temperature may fall below approximately 50° F., the bulbs are typically enclosed in a manner designed to conserve the heat which they generate so as to warm them to their designed operating temperature. However, because such fixtures are relatively heavy and expensive, they are not practical for relatively small fluorescent lamps of the type intended to be connected to a standard 120 v threaded lamp holder or socket. In addition, fluorescent lamps of this type typically have low wattage light bulbs which would not produce enough heat to warm themselves to their designed operating temperature for many commonly encountered ambient temperature conditions, even if the bulbs were enclosed in insulated housings.

SUMMARY OF THE INVENTION

Among the several objects of this invention may be noted the provision of a ballast circuit for a fluorescent lamp intended to be exposed to ambient temperatures substantially below the designed operating temperature of the bulb for increasing the light output of the lamp at such ambient temperatures; the provision of such a ballast circuit which is economical and compact and thus may be used in relatively small fluorescent lamps intended to be connected to a standard 120 v threaded lamp socket; and the provision of such a ballast circuit which may be used with fluorescent lamps having light bulbs of different wattage values, including relatively low wattage light bulbs.

In general, the ballast circuit of this invention is adapted to be connected in series with the gaseous discharge light bulb of a fluorescent lamp and has a first impedance at the designed operating temperature of the bulb. The ballast circuit further includes means for sensing the ambient temperature in the vicinity of bulb and means responsive to the sensing means for decreasing the impedance of the ballast circuit below said first impedance if the ambient temperature falls below a predetermined temperature less than the designed operating temperature to increase the bulb current and thus the light output of the bulb, whereby the light output of the bulb is increased for ambient temperatures below said predetermined temperature.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
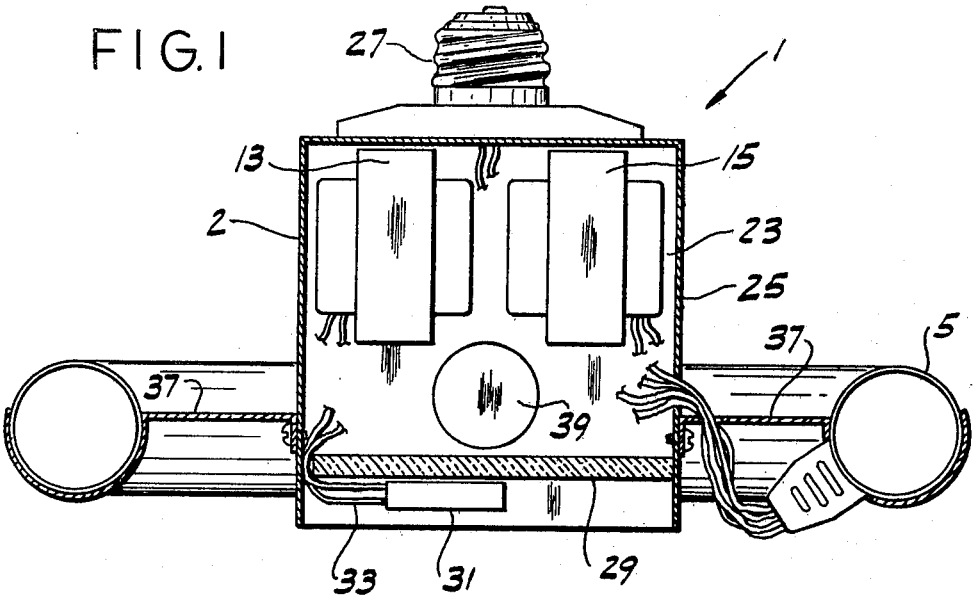
FIG. 1 is a vertical central section of a fluorescent lamp comprising a fixture in which are housed electrical components of a first embodiment of the ballast circuit of this invention, and a light bulb mounted on the fixture.
Figure 2:
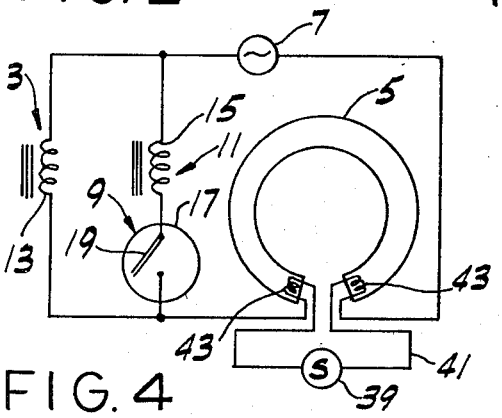
FIG. 2 is a circuit diagram of the first embodiment of the ballast circuit.

Referring to FIG. 1, there is generally indicated at 1 a fluorescent lamp comprising a fixture 2 in which are housed electrical components of a first embodiment of a ballast circuit of this invention generally indicated at 3 in FIG. 2, and a light bulb 5 of generally annular shape mounted on the fixture. This light bulb is of the gaseous discharge type producing a decreasing amount of light as the ambient temperature in the vicinity of the bulb (and thus the bulb-wall temperature) decreases below the designed operating temperature (approximately 77° F.) at which the amount of light produced is a maximum.

The ballast circuit 3 connects the light bulb 5 to a source of power 7 as shown schematically in FIG. 2 and presents a first and relatively high impedance at the designed operating temperature of the bulb. The circuit includes means generally indicated at 9 for sensing the ambient temperature in the vicinity of the bulb, and means generally indicated at 11 responsive to the sensing means for decreasing the impedance of the ballast circuit below its stated first impedance if the ambient temperature falls below a predetermined threshold temperature (e.g., approximately 50° F.) less than the designed operating temperature to increase the bulb current and thus the light output of the bulb, whereby the light output of the bulb is maintained for ambient temperatures below the threshold temperature.

As further shown in FIG. 2, the ballast circuit comprises a choke or inductor 13 connected in series with the bulb 5, the choke 13 functioning as a ballast for the bulb and constituting a primary impedance for the ballast circuit. The means 11 comprises an auxiliary choke or inductor 15 connected in parallel with the ballast choke 13 and constituting a secondary impedance for the ballast circuit, and a single pole, single throw switch 17 connected in series with this secondary impedance.

The sensing means 9 comprises a bi-metal strip 19 constituting the movable member of the switch 17, means 11 of course not including strip 19. At ambient temperatures above the predetermined threshold temperature (i.e., above approximately 50° F.), the bi-metal strip 19 opens switch 17, thereby effectively removing the auxiliary choke 15 from the ballast circuit. With the auxiliary choke effectively out of the circuit, ballast circuit 3 presents its first and relatively high impedance. At ambient temperatures below the stated predetermined threshold temperature (i.e., below approximately 50° F.), the bi-metal strip 19 closes the switch for connecting the auxiliary choke 15 in the ballast circuit in parallel with the ballast choke 13. With the auxiliary choke connected in the ballast circuit, the impedance of the ballast circuit is reduced to a second impedance less than its first impedance, and the bulb current is increased. The amount of light produced by the bulb 5, which is also dependent on the bulb current, increases as the bulb current increases, whereby the light output of the bulb is maintained for ambient temperatures below the stated predetermined threshold temperature.

The fixture 2 comprises a box-like housing 23 having side walls formed of suitable sheet material, such as galvanized sheet steel, and a threaded projection 27, similar to the base of a standard 120 V incandescent light bulb, at one end thereof (i.e., its upper end as shown). The projection 27 thus is adapted to be threaded in a standard 120 V light socket and it includes the terminals of the fluorescent lamp. The housing 23 further has a bottom member 29, preferably formed of insulating material, secured to the walls 25 of the housing above the lower ends thereof to form a recessed bottom in the housing. As illustrated in FIG. 1, the ballast choke 13 and the auxiliary choke 15 are mounted in side-by-side relation in the housing adjacent the upper end thereof by conventional fasteners (not shown). The switch 17 is received within a suitable enclosure 31 mounted on the underside of the bottom member 29 generally at the center thereof, the wiring, designated 33, for the switch extending up through a recess 35 in a side edge of the bottom member. Being positioned at the recessed bottom of the housing 2, the switch 17 and the bi-metal strip 19 are at least partially protected against damage, yet are exposed to ambient temperature conditions. The bottom member 29 thermally insulates the bi-metal strip 19 from the chokes 13, 15 to prevent the heat generated by these chokes from affecting the operation of the switch 17. The light bulb 5 is mounted on the housing in surrounding relation thereto by supports 37 extending laterally outwardly from the walls 25 of the housing.

A conventional glow-bottle starting switch 39 is mounted in the housing 23 between the chokes 13, 15 and the bottom member 29 by suitable fasteners (not shown). This switch is connected in a starting circuit 41 including the cathodes 43 at the ends of the bulb 5, each cathode having a first terminal connected to the starting switch 39 and a second terminal connected in the ballast circuit 3. Upon closing the starting switch the starting circuit is completed between the first terminals of the cathodes 43 and current thus flows through the cathodes to preheat them. Subsequent opening of the starting switch causes an inductive surge in the ballast circuit 3 which is applied across the heated cathodes for striking an arc between the cathodes through the tube 5 to produce light.

Figure 3:
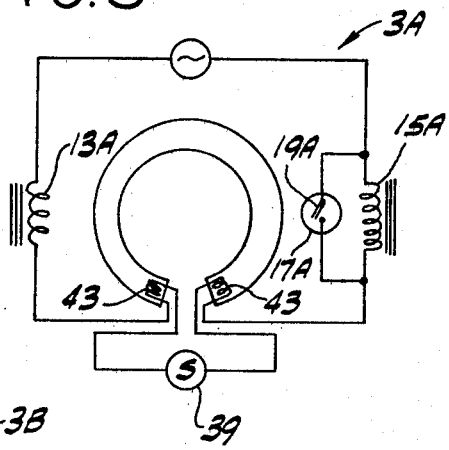
FIG. 3 is a circuit diagram of a second embodiment of the ballast circuit.

FIG. 3 illustrates schematically a second embodiment of the ballast circuit of this invention designated 3A which is similar to the first embodiment 3 except that the auxiliary choke 15A is connected in series with the ballast choke 13A and the switch 17A is connected in parallel with the auxiliary choke. The bi-metal strip 19A opens the switch 17A at ambient temperatures above the predetermined threshold temperature, with the auxiliary choke 15A thus being connected in the ballast circuit and the ballast circuit thereby presenting its first and relatively high impedance. The bi-metal strip 19A closes the switch 17A at temperatures below the predetermined threshold temperature to shunt the auxiliary choke, with the impedance of the ballast circuit thus being reduced to its second and lower impedance, and the bulb current and the amount of light output of the light bulb thus being maintained. The chokes 13A, 15A and the switch 17A of this embodiment of the ballast circuit may be mounted in a fluorescent lamp fixture in a manner generally similar to the manner in which the chokes 13, 15 and the switch 17 are mounted in the fixture 2, as shown in FIG. 1.

Figure 4:
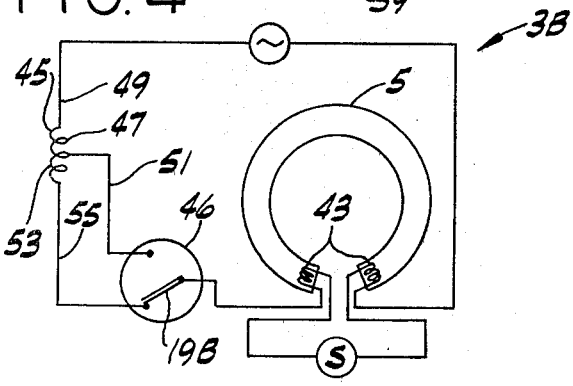
FIG. 4 is a circuit diagram of a third embodiment of the ballast circuit.

FIG. 4 illustrates schematically a third embodiment of the ballast circuit of this invention designated 3B which is similar to the second embodiment 3A except a tapped inductor 45 is included in the ballast circuit in lieu of chokes 13A, 15A, and a double pole-single throw switch 46 is included in the circuit in lieu of the switch 17A. The inductor 45 has a first coil segment 47 between an input lead 49 and an intermediate lead 51 to the inductor corresponding to the ballast choke 13A, and a second coil segment 53 between the intermediate lead 51 and an output 55 lead to the inductor corresponding to the auxiliary choke 15A. The switch 46 is connected in series with the bulb 5, with one of its poles being connected to the intermediate lead 51 and the other pole being connected to the output lead 55. The bi-metal strip 19B holds the switch in a first position at temperatures above the predetermined threshold temperature for connecting both coil segments 47, 53 of the inductor in the ballast circuit, the ballast circuit thus presenting its first and relatively high impedance. The bi-metal strip 19B holds the switch in a second position at ambient temperatures below the predetermined threshold temperature for completing a circuit between the intermediate lead 51 and the light bulb 5, thereby shunting the second coil segment 53. With the second coil segment shunted, the impedance of the ballast circuit is reduced to its second and lower impedance, and the bulb current and the amount of light output are thus increased. The tapped inductor 45 and the switch 46 may be mounted in a fluorescent lamp fixture in a manner generally similar to the manner in which the chokes 13, 15 and switch 17 are mounted in the fixture 2.

It will be observed that each of the three embodiments 1–1B of the ballast circuit of this invention has a first impedance at the designed operating temperature of the bulb 5, and includes means 19–19/B for sensing the ambient temperature in the vicinity of the bulb, and means responsive to the sensing means for decreasing the impedance of the ballast circuit below said first impedance if the ambient temperature falls below a predetermined threshold temperature less than the designed operating temperature to increase the bulb current and thus the light output of the bulb, whereby the light output of the bulb is maintained for ambient temperatures below said predetermined threshold temperature.

While the secondary impedances of the first and second embodiments of the ballast circuit have been shown and described as being constituted by chokes, it is contemplated that these impedances may be resistors. Moreover, while the ballast circuit is shown as being used with a relatively small, portable fluorescent lamp 1, it is contemplated that it may also be used with fluorescent lamps of the so-called "light fixture" type which are relatively large and intended to be permanently mounted.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A ballast circuit for a fluorescent lamp including a gaseous discharge light bulb which for a given input power produces a decreasing amount of light as the bulb temperature decreases below a designed operating temperature at which the amount of light produced is a maximum, the ballast circuit comprising:

means for sensing the ambient temperature in the vicinity of the bulb;

the ballast circuit being adapted to be connected in series with the bulb and having multi-stage impedance means controlled by said sensing means for imposing a predetermined impedance in the circuit when the ambient temperature is above a threshold temperature which is generally a predetermined number of degrees below said designed operating temperature, and for imposing a lower impedance when the ambient temperature is below said threshold temperature to increase the bulb current and thus the light output of the bulb, whereby the light output of the bulb is maintained for ambient temperatures below said threshold temperature.

2. A ballast circuit as set forth in claim 1 wherein said sensing means comprises a bi-metal thermostat means.

3. A ballast circuit as set forth in claim 2 wherein said impedance means comprises a primary impedance in series with said bulb, and a secondary impedance connected in parallel with said primary impedance and in series with said thermostat means, said thermostat means being open at ambient temperatures above said threshold temperature and being closed at temperatures below said threshold temperature to reduce the impedance of the ballast circuit.

4. A ballast circuit as set forth in claim 2 wherein said impedance means comprises a primary impedance in series with the bulb and a secondary impedance connected in series with the primary impedance and in parallel with said thermostat means, said thermostat means being open at ambient temperatures above said threshold temperature and being closed by at temperatures below said threshold temperature to shunt the secondary impedance thereby reducing the impedance of the ballast circuit.

5. A ballast circuit as set forth in claim 2 wherein the thermostat means comprises a double pole switch, and wherein said impedance means comprises a tapped inductor having first and second coil segments, the first coil segment being connected between an input lead and an intermediate lead and the second coil segment being connected between the intermediate lead and an output lead, the switch being connected in series with the bulb with one of its poles being connected to the output lead and the other being connected to the intermediate lead, the switch being held in a first position at temperatures above the threshold temperature for connecting both coil segments in the ballast circuit in series with the bulb, the switch being held in a second position at temperatures below the threshold temperature for connecting only the first coil segment in the ballast circuit, thereby reducing the impedance of the ballast circuit.

6. A fluorescent lamp comprising:

a gaseous discharge light bulb, which for a given input power produces a decreasing amount of light as the bulb temperature decreases below a designed operating temperature at which the amount of light produced is a maximum;

a fixture for supporting the bulb; and a ballast circuit comprising a ballast carried by the fixture and connected in series with the bulb, means for sensing the ambient temperature in the vicinity of the bulb, the ballast circuit having multi-stage impedance means controlled by said sensing means for imposing a predetermined impedance in the circuit when the ambient temperature is above a threshold temperature which is generally a predetermined number of degrees below said designed operating temperature, and for imposing a lower impedance when the ambient temperature is below said threshold temperature to increase the bulb current and thus the light output of the bulb, whereby the light output of the bulb is maintained for ambient temperatures below said threshold temperature.

7. A fluorescent lamp as set forth in claim 6 wherein the sensing means is mounted on the fixture adjacent the bulb.

8. A fluorescent lamp as set forth in claim 7 further including means for thermally insulating the sensing means from the ballast.

9. A fluorescent lamp as set forth in claim 8 wherein the insulating means comprises insulation material carried by the fixture.

10. A fluorescent lamp as set forth in claim 6 wherein said sensing means comprises a bi-metal thermostat means.

11. A fluorescent lamp as set forth in claim 10 wherein said impedance means comprises a primary impedance in series with said bulb, and a secondary impedance connected in parallel with said primary impedance and in series with said thermostat means, said thermostat means being open at ambient temperatures above said threshold temperature and being closed at temperatures below said threshold temperature to reduce the impedance of the ballast circuit.

12. A fluorescent lamp as set forth in claim 10 wherein said impedance means comprises a primary impedance in series with the bulb and a secondary impedance connected in series with the primary impedance and in parallel with said thermostat means, the thermostat means being open at ambient temperatures above said threshold temperature and being closed at temperatures below said threshold temperature to shunt the secondary impedance thereby reducing the impedance of the ballast circuit.

13. A fluorescent lamp as set forth in claim 10 wherein the thermostat comprises a double pole switch, and wherein said impedance means comprises a tapped inductor having first and second coil segments, the first coil segment being connected between an input lead and an intermediate lead and the second coil segment being connected between the intermediate lead and an output lead, the switch being connected in series with the bulb with one of its poles being connected to the output lead and the other being connected to the intermediate lead, the switch being held in a first position at temperatures above the threshold temperature for connecting both coil segments in the ballast circuit in series with the bulb, the switch being held in a second position at temperatures below the threshold temperature for connecting only the first coil segment in the ballast circuit, thereby reducing the impedance of the ballast circuit.

* * * * *